US005540618A

United States Patent [19]

Alwis et al.

[11] Patent Number: 5,540,618

[45] Date of Patent: Jul. 30, 1996

[54] PASSIVE ATTENUATOR FOR SHELTER PROTECTION AGAINST EXPLOSIONS

[75] Inventors: Weeramuni A. M. Alwis; Oi Yin M. K. Chong, both of Singapore, Singapore

[73] Assignee: National University of Singapore, Singapore, Singapore

[21] Appl. No.: 330,734

[22] Filed: Oct. 28, 1994

[51] Int. Cl.[6] ..... F24F 7/00

[52] U.S. Cl. ..... 454/194; 454/902

[58] Field of Search ..... 109/15; 454/194, 454/902

[56] References Cited

U.S. PATENT DOCUMENTS

| | | | |
|---|---|---|---|
| 3,121,384 | 2/1964 | Brode | 454/194 |
| 3,402,655 | 9/1968 | Stehenson et al. | 454/902 X |
| 4,751,874 | 6/1988 | Quarterman | 454/194 |
| 5,187,316 | 2/1993 | Hasler et al. | 454/196 X |

FOREIGN PATENT DOCUMENTS

| | | | |
|---|---|---|---|
| 88276 | 3/1960 | Denmark | 454/902 |
| 0489183 | 6/1992 | European Pat. Off. . | |
| 948550 | 9/1956 | Germany | 454/902 |

*Primary Examiner*—Harold Joyce
*Attorney, Agent, or Firm*—Birch, Stewart, Kolasch & Birch

[57] ABSTRACT

A family of passive attenuators for shelter protection against explosions which reduce the pressure and impulse by combined effects of reflection, expansion, contraction and deviation contributed by the geometry of the attenuator.

6 Claims, 17 Drawing Sheets

PASSIVE ATTENUATOR FOR SHELTER PROTECTION AGAINST EXPLOSIONS

BACKGROUND OF THE INVENTION

1. Field of the Invention

The invention relates to a family of passive attenuators for shelter protection against explosions. Attenuators are devices which allow ventilation air to pass through and are capable of reducing intensity of pressure and impulse of impinging blast waves from the outside.

2. Description of a Related Art

A wide variety of attenuation devices are available and may be classified broadly on the basis of their mode of operation, as passive or active. Active attenuators (or blast valves) have moving parts activated by the blast pressure which can close ventilation gaps shutting out the blast. These closure times are typically of the order of 5 ms. For conventional weapons, this response time is too slow for effective attenuation. In addition, it has been reported that some types of active valves were found to be relatively fragile, seizing shut under repeated high blast pressures from conventional weapons. The valves also have to undergo frequent maintenance to ensure free movement and proper seating of moving pans.

Passive attenuators have no moving pans and reduce the pressure and impulse by combined effects of reflection, expansion, contraction and deviation contributed by the geometry of the attenuator. They are rugged and require little maintenance.

SUMMARY OF THE INVENTION

The object of the invention is the provision of a passive attenuation device which is effective against short term pressure surges; has an increasing effect with the rise in pressure intensity of the pressure surge and cause a low pressure drop during normal ventilation. This object is achieved by providing a passive explosion protection device for air passing in a shelter comprising:

an inlet having an entry opening, and an outlet opening for connection to said shelter, said air flow being directed from said inlet to said outlet opening, said entry opening connecting with a straight entry passage, said entry passage connecting with a connection chamber; and an expansion chamber immediately adjoining said connection chamber, said expansion chamber having a single opening directly confronting said entry opening, said expansion chamber opening aligned with and of the same cross-section as said entry opening, said connection chamber being continuously connected via a straight lateral outlet passage to said outlet opening such that said outlet passage and said expansion chamber share a common wall, said outlet passage being perpendicular to said entry passage, and a lateral dimension of said expansion chamber being greater than said expansion chamber opening.

BRIEF DESCRIPTION OF THE DRAWINGS

The accompanying drawings illustrate the basic configuration of the passive attenuator for protection against explosions conceived in this invention, and some variations suitable for a variety of applications. The drawings are given by way of illustration only, and thus do not limit the present invention. Also included in the figures are a series of results from computational analysis used to assess the performance of the proposed passive attenuator designs.

DETAILED DESCRIPTION OF THE PREFERRED EMBODIMENTS

Figure 1:
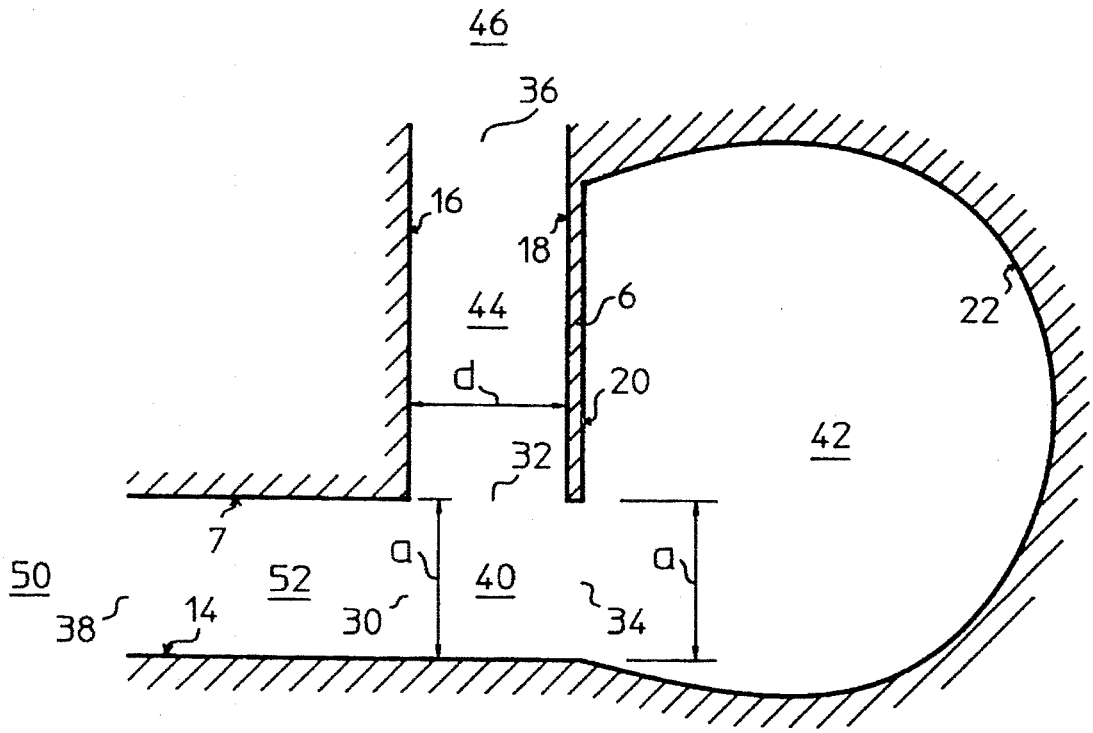
FIG. 1 shows a sectional view of the basic geometrical configuration of the passive attenuator conceived in this invention.

A geometrical configuration is conceived in this invention and is illustrated in FIG. 1 showing a sectional view. An entry passage 52 opens to an external zone 50 through an opening 38. A connection chamber 40 is accessible from the entry passage 52 through an opening 30. An exit passage 44 and the expansion chamber 42 are accessible from the connection chamber 40 through the openings 32 and 34, respectively. The exit passage 44 opens to a shelter zone 46 through an opening 36. The expansion chamber 42 is accessible only through the opening 34 and is bounded by rigid boundaries 20 and 22. A rigid straight boundary 16 and a rigid thin walled element 6 are parallel to each other and form the exit passage of uniform width d. Similarly, rigid straight boundaries 7 and 14 are parallel and form the entry passage of width a. The opening 34 is aligned with the entry passage 52 and is of the same width a.

In a normal ventilation mode, air can freely pass between the zone 50 and 46 through the entry passage 52, connection chamber 40 and exit passage 44. The air in the expansion chamber 42 would in general remain stationary. The energy loss during air flow increases with increase in flow rate and decrease 5 with any increase in widths a and d.

A high pressure pulse caused by an explosion, arriving through the external zone 50 will travel through the opening 38 and propagate through the entry passage 52 towards the opening 30, without any significant change in the peak intensity and the time distribution of the pressure pulse. The expansion that occurs as the pressure pulse distributes across the connection chamber 40 and spreads through the openings 32 and 34, causes the peak intensity to drop by a certain amount. Because the exit passage 44 is perpendicular to the entry passage 52, the peak intensity of the pressure pulse that is set to propagate through the exit passage becomes significantly reduced. The intensity of the pressure pulse that enters the expansion chamber 42 will drop due to the spatial distribution. The reflections on the boundaries of the expansion chamber however, will generate a larger pressure intensity which will emerge through the opening 34 as a pressure pulse that travels towards the entry passage 52. This reflected pressure pulse drops in intensity somewhat as it spreads through the connection chamber 40 and then sets up a second pressure pulse through the exit passage 44 and a continuing reflected wave through the entry passage 52. Since the opening 34 through which the reflected pressure emerges is perpendicular to the opening 32, the peak pressure intensity of the second pulse through the exit passage 44 is significantly less than the peak intensity of the reflected pressure that emerges from the expansion chamber. The pressure pulse that is sent back through the entry passage toward zone 50 however, will have a relatively large pressure intensity since the direction of the pressure wave emerging from the expansion chamber is not altered. In summary, the overall result in response to a pressure originating from zone 50 propagating through the entry passage 52 is mainly two pulses of diminished intensity arriving in zone 46 through the opening 36 and a reflected pressure pulse sent back though the entry passage 52. The significant reduction in intensity of the peak pressure without a significant increase in duration, ensures that the impulse also is effectively reduced.

The proposed configuration of the attenuator has a simple geometry and can be adopted for a variety of applications such as accessways, entrances, pipes, ducts and ventilation openings in various geometrical scales.

Application I: Attenuation in accessways and ducts

Figure 2:
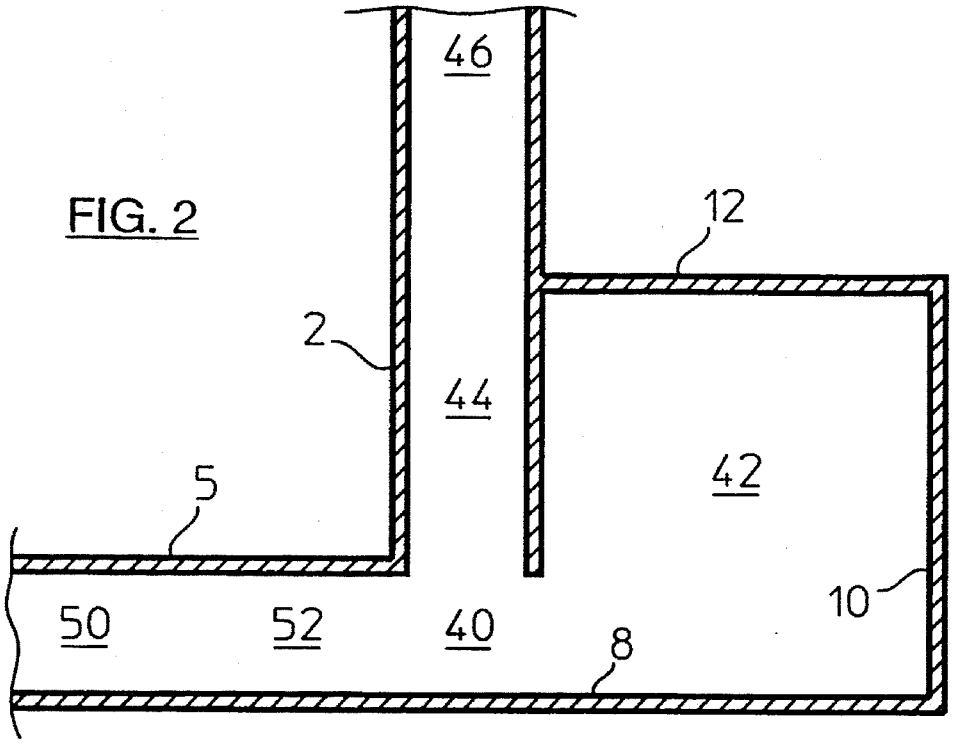
FIG. 2 shows a sectional view of a passive attenuator application suitable for accessways and ducts.
Figure 3:
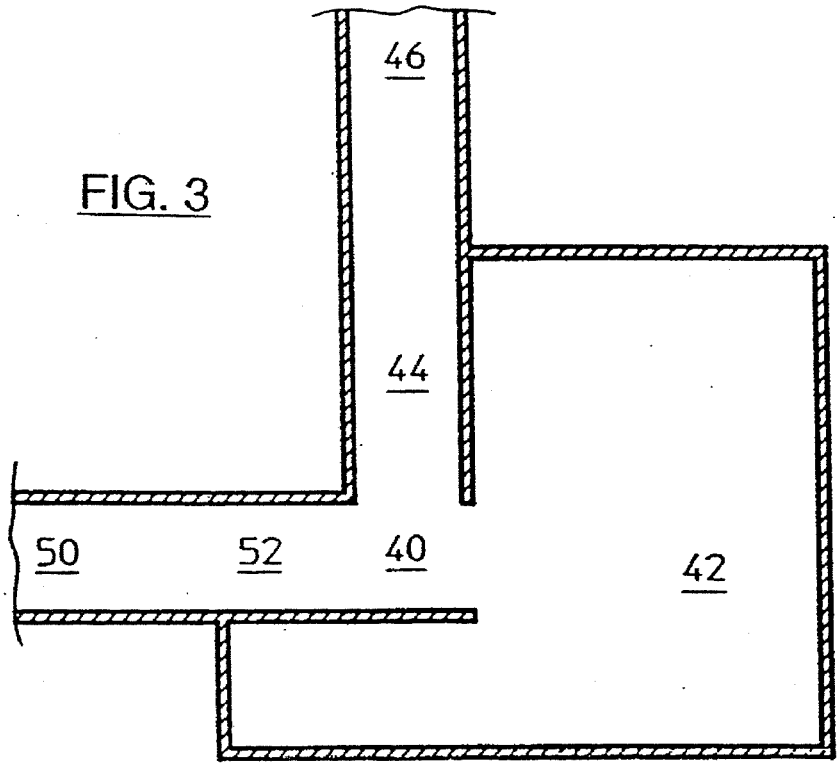
FIG.3 shows a sectional view of a variation in design of the expansion chamber.
Figure 4:
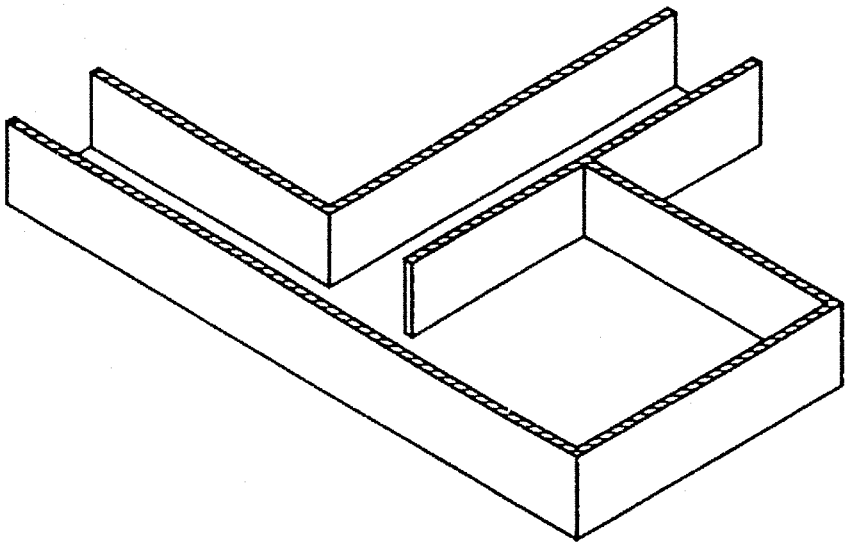
FIG.4 shows a segment of the prismatic version of the passive attenuator design arising from the sectional view of FIG. 2.
Figure 5:
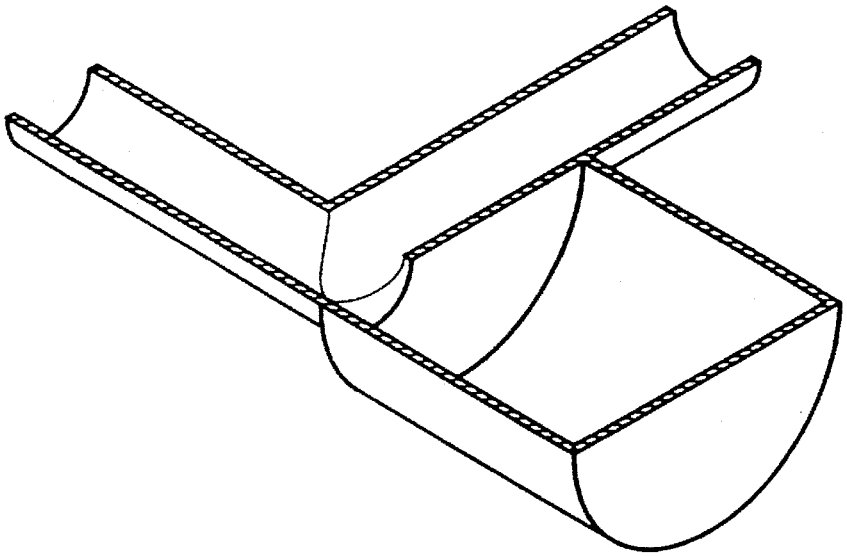
FIG. 5 shows the attenuator design for a pipe or duct of circular cross-section with a symmetric half removed to show internal detail.

Illustrated in FIG. 2 is a sectional view of an attenuator application suitable for access-ways and ducts. The attenuator is at a 90 degree turn of the accessway or duct. Parallel wall sections 5 and 8 form the entry passage. Parallel wall sections 2 and 6 form the exit passage. The wall sections 6, 8, 10 and 12 form the rectangular sectional area of the expansion chamber. A variation of the expansion chamber configuration is shown in FIG. 3. A segment of the prismatic version of the attenuator design arising from the sectional view of FIG. 2, is illustrated in FIG. 4. The design for a pipe or duct of circular cross section is illustrated in FIG. 5 with a symmetric half removed to show internal detail. The geometry shown in FIG. 5 can be modified to suit pipes and ducts of rectangular or other polygonal cross sections. Furthermore, expansion chambers in the designs illustrated in FIGS. 4 and 5 can be modified to match with the sectional view of FIG. 3.

Figure 6A:
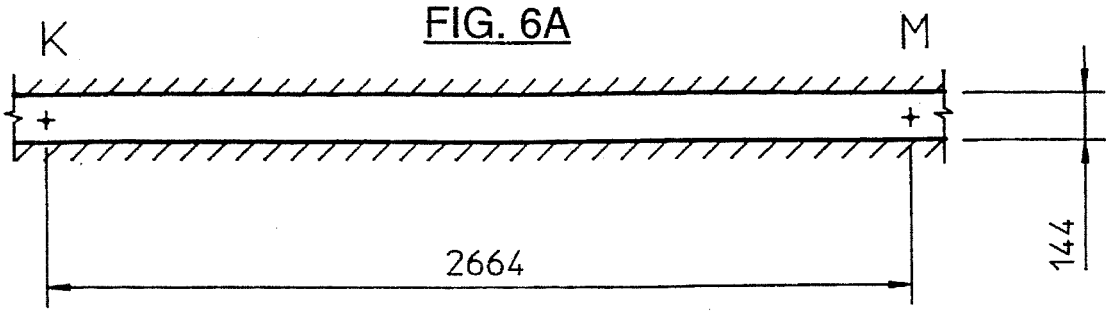
FIG. 6A, 6B and 6C show various duct configurations, for which, computer analysis was carried out to assess the performance of the proposed attenuator designs.
Figure 6B:
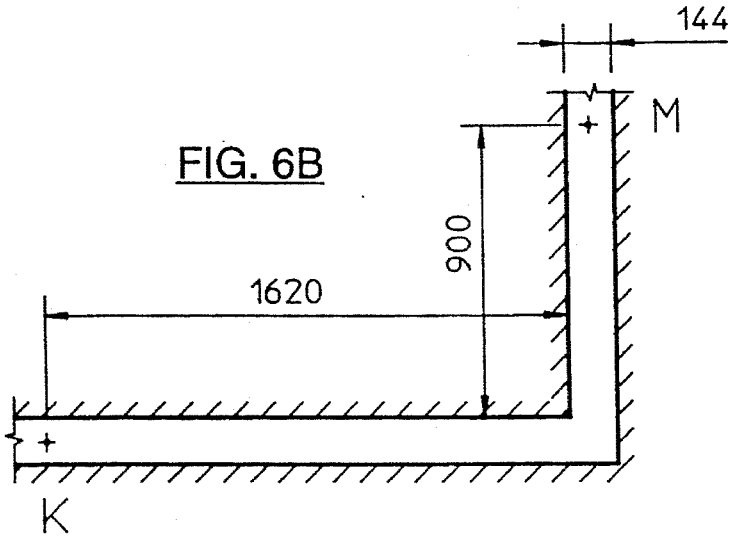
Figure 6C:
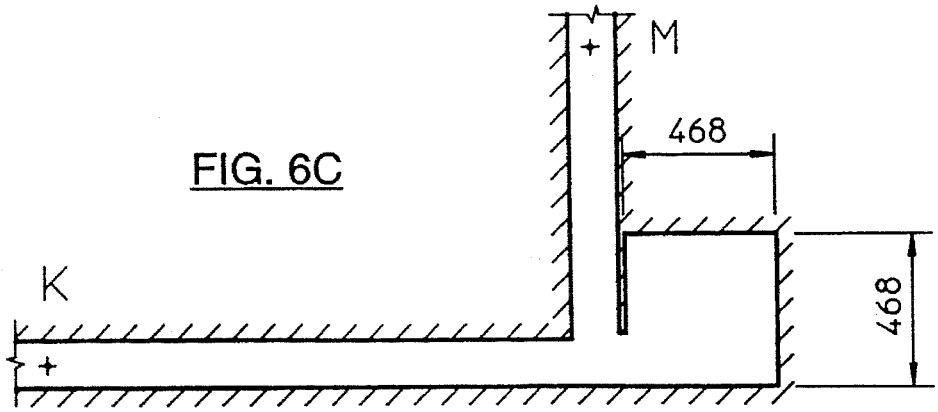
Figure 7:
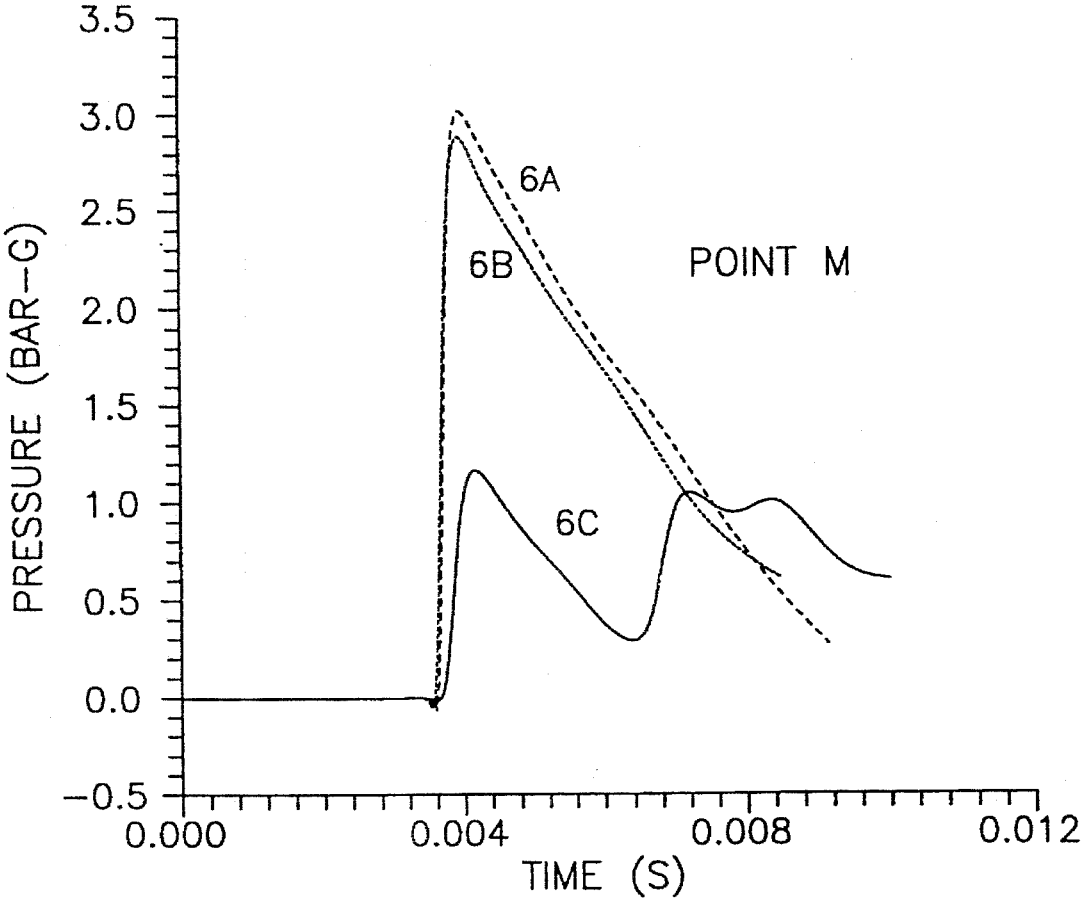
FIG. 7 shows the pressure-time graphs obtained from computer analysis of the duct configurations illustrated in FIG. 6.

A computer analysis was carded out to assess the performance of the proposed attenuator designs. Results for the various rectangular ducts illustrated in FIG. 6 are compared in FIG. 7. A two-dimensional analysis was carried out for a duct of width 144 mm. If the duct was straight as illustrated in FIG. 6A, a pressure pulse of peak intensity 4 bar guage which decays linearly over a 5 ms duration at Point K, will get reduced to a pressure intensity of 3.1 barg at Point M after propagating through a distance of 2.66 m. If the duct was bent by a 90 degree angle as shown in FIG. 6B the pressure intensity at Point M after propagating through the same distance is 2.95 barg, showing a slight attenuation due to the bend. When an attenuator of the form shown in FIG. 6C with a 468 by 468 mm expansion chamber was introduced, the pressure intensity at the second location, Point M, dropped to 1.20 barg. This shows a 59% reduction of the peak pressure intensity when compared to a normal right angle bend without the attenuator arrangement.

Application 2: Ventilation opening of an equipment enclosure.

Figure 8:
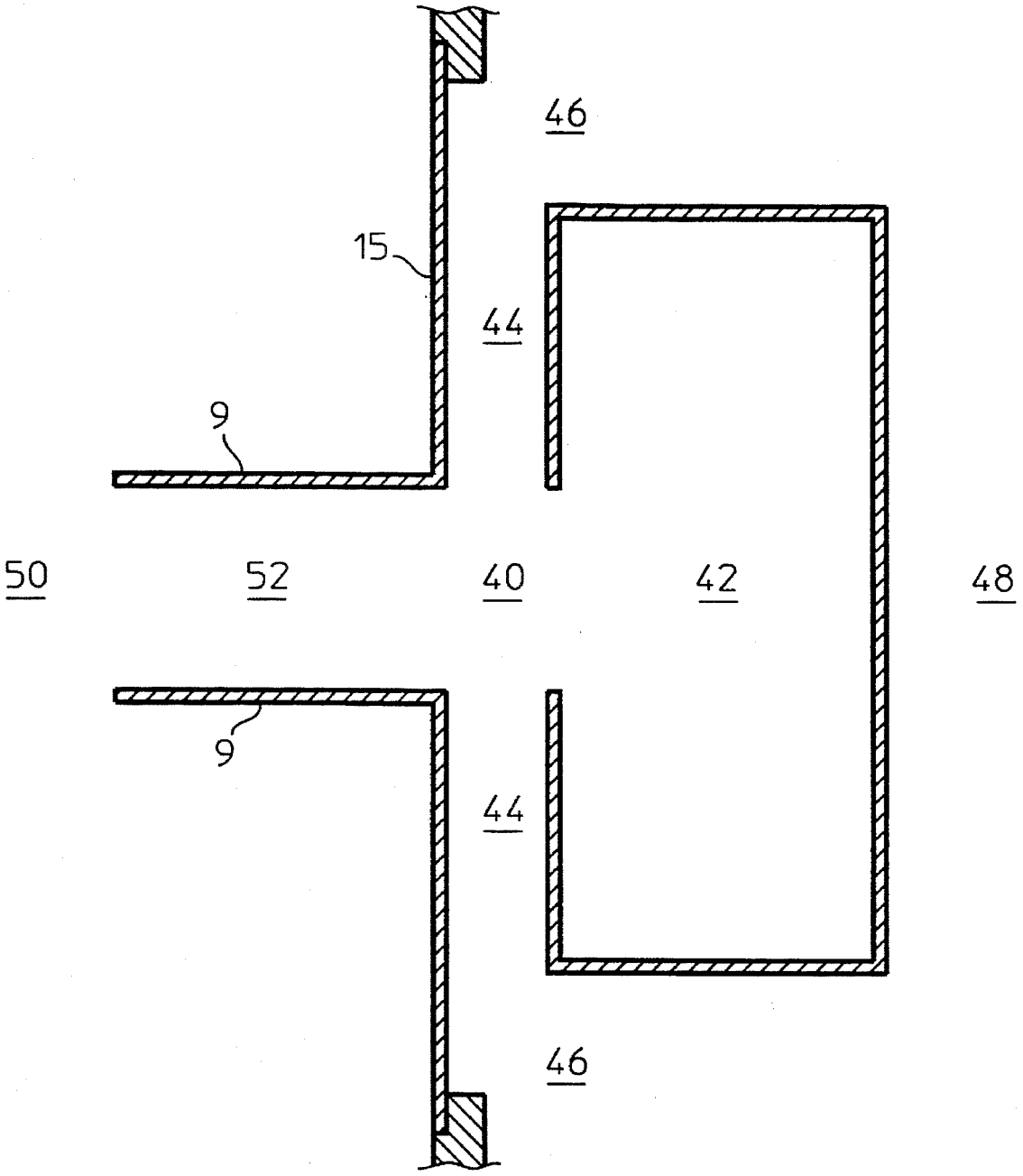
FIG. 8 shows a sectional view of an attenuator suitable for a ventilation opening of an equipment enclosure.

A sectional view of an attenuator suitable for a ventilation opening of an equipment enclosure is shown in FIG. 8, which is derived by combining the basic configuration of FIG. 1 with its mirror image to obtain a symmetric geometry. The surface 14 becomes the line of symmetry and hence it ceases to be a physical boundary. A blast pressure front propagating through the zone 50 toward the shelter will enter entry zone 52 contained between the parallel wall sections 9 protruding out from the attenuator. The pressure front that is not intercepted by the attenuator opening will reflect on exposed surface 15 of the shelter wall. The reflected pressure intensity will be larger than the original pressure intensity. The wall 9 prevents this reflected pressure from interfering significantly with the original pressure pulse that enters the attenuator. Attenuation action of the other components of the configuration is the same as those of the basic configuration described above. The peak intensity of pressure and the impulse received at zone 46 and 48 would be significantly less than the original magnitudes experienced in zone 50.

Figure 9:
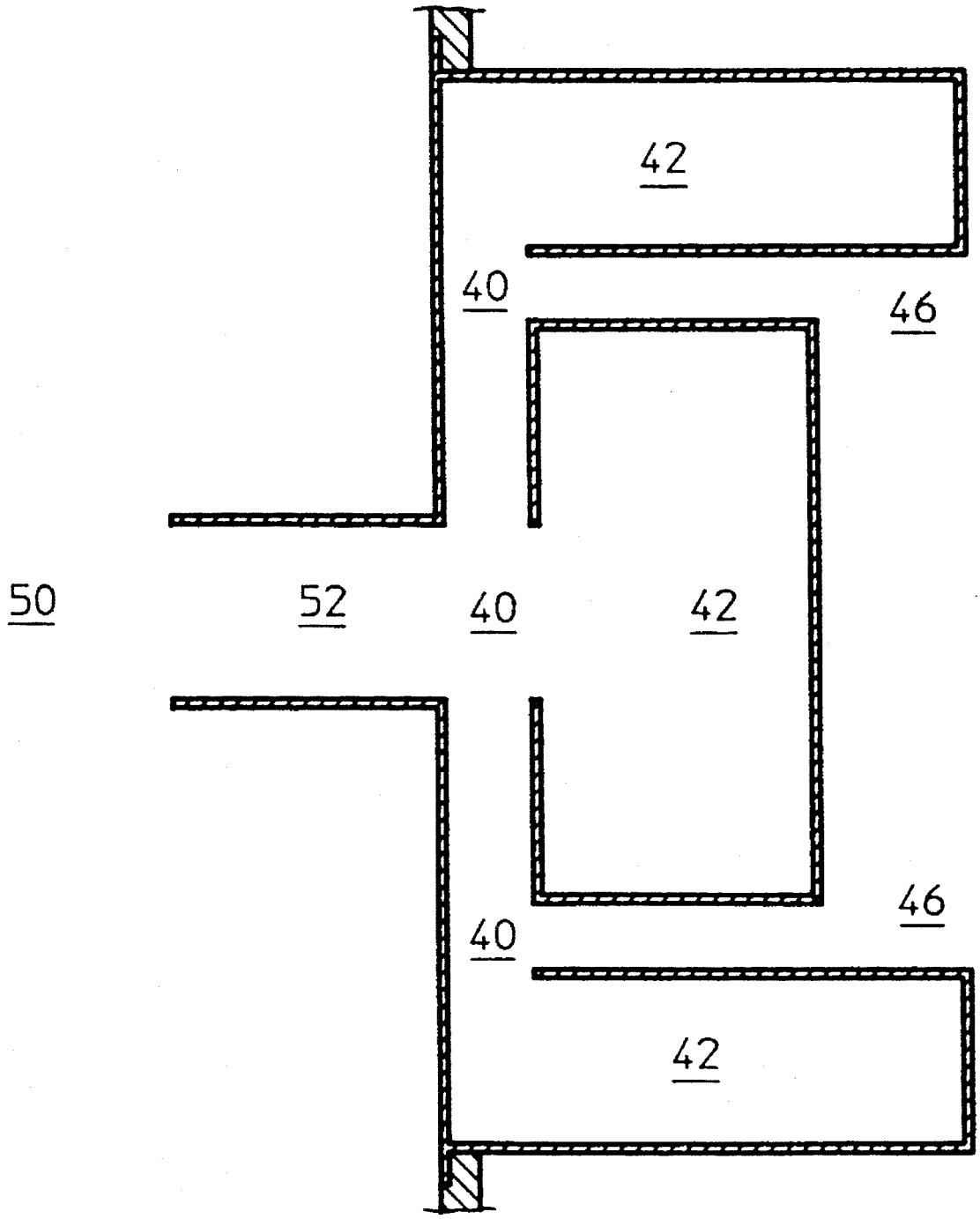
FIG. 9 shows a sectional view of an enhanced configuration of an attenuator, suitable for a ventilation opening of an equipment enclosure, which is derived by adding a second attenuator to the sectional view of FIG. 8.

An enhanced configuration which is derived by adding a second attenuator to the sectional configuration of FIG. 8, is shown in FIG. 9. The exit passage of the first attenuator is treated as the entry passage of the second attenuator. The enhancement of performance is due to the sequential action of the two basic attenuator configurations.

Figure 10:
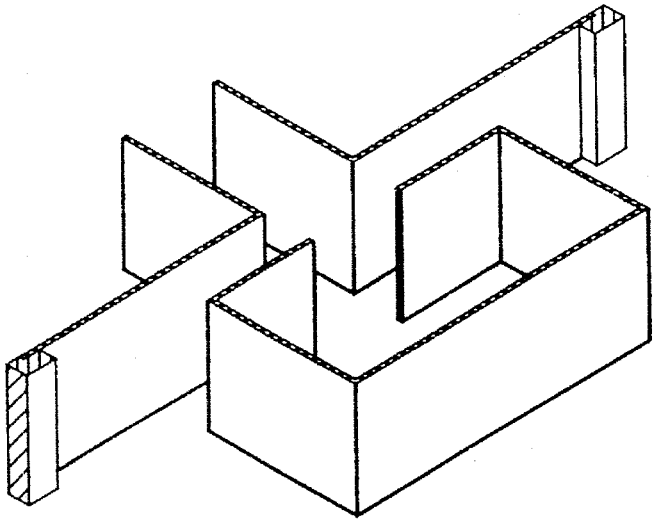
FIG. 10 and FIG. 11 show prismatic versions of the passive attenuators that can be derived from the sectional views illustrated in FIG. 8 and FIG. 9 respectively.
Figure 11:
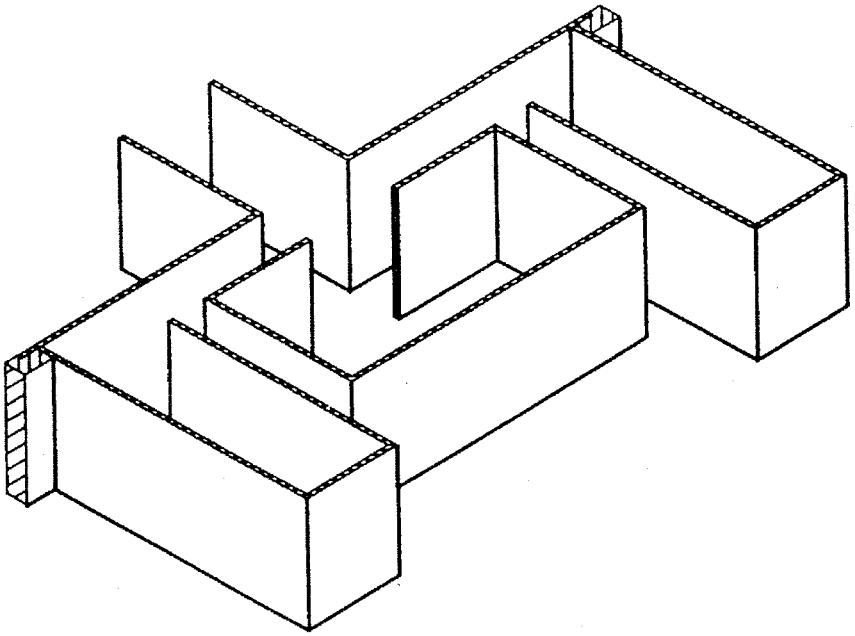
Figure 12:
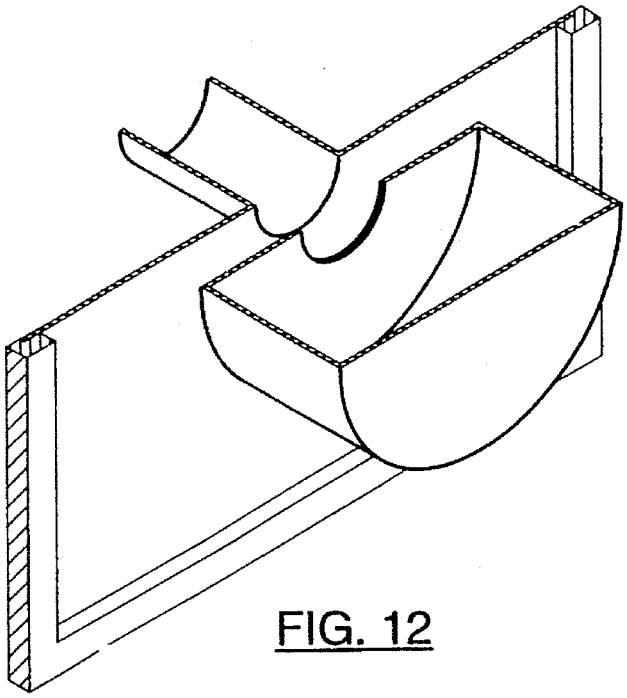
FIG. 12 and FIG. 13 circular versions of the passive attenuators that can be derived from the sectional views illustrated in FIG. 8 and FIG. 9 respectively.
Figure 13:
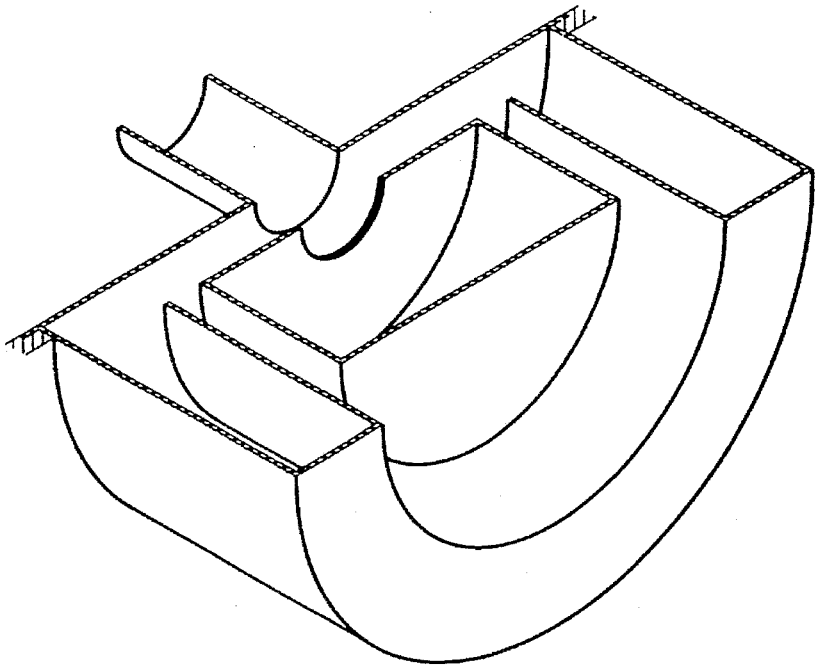

Prismatic versions of the attenuators that can be derived from the sectional configurations shown in FIGS. 8 and 9 are illustrated in FIGS. 10 and 11; circular versions of the attenuators are illustrated in FIGS. 12 and 13. As noted earlier, the circular geometries can be modified to implement rectangular or other polygonal geometries.

Application 3: Opening of a ventilation duct

Figure 14:
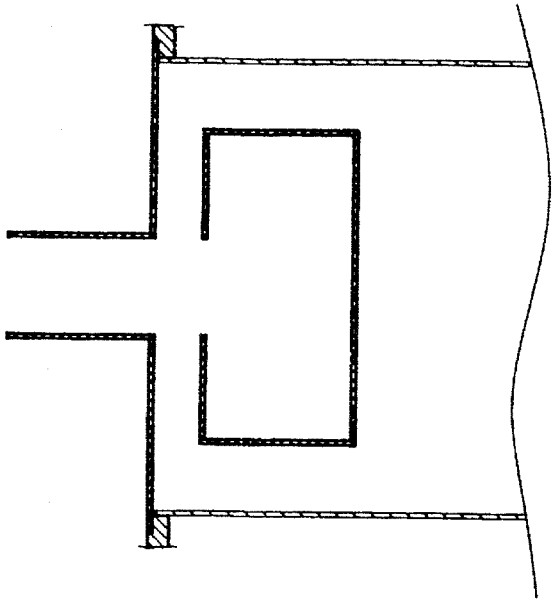
FIG. 14 shows a sectional view of the basic attenuator configured for a ventilation duct opening.
Figure 15:
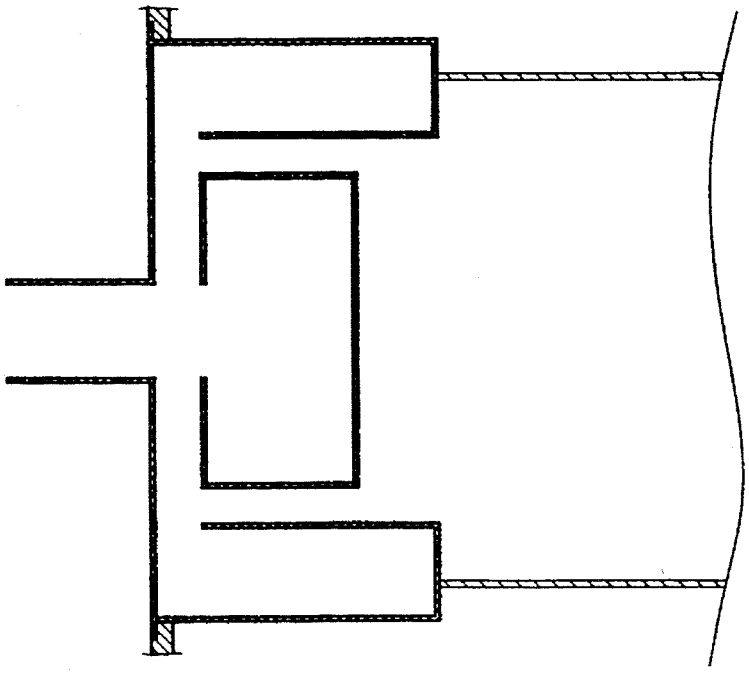
FIG. 15 shows a sectional view of the enhanced attenuator configured for a ventilation duct, opening.

Shown in FIGS. 14 and 15 are sectional views of the basic and enhanced attenuators which are configured for a ventilation duct opening. The attenuating action of this design is the same as with the configuration in FIGS. 8 and 9. The principle of operation is as described above, except for that the exit passages open to the interior of a duct meant for ventilation purposes.

A computer analysis in which various alternatives for a ventilation opening is compared and presented in the following. Four configurations, referred to as Case A, B, C, and D, and illustrated in FIGS. 16A, 16B, 16C, and 16D, respectively, are considered. Respective pressure-time graphs are labelled as A, B, C and D, in FIGS. 17A and 17B. The source pressure pulse at Point P, at a distance 1.44 m from the wall of the shelter, is of peak intensity 4 barg, decaying linearly over 5 ms. Upon reflection on the shelter wall, the peak intensity rises above 10 barg. Four different configurations for the ventilation opening are considered, all are axisymmetric about the centroidal axis shown. Pressure-time response inside the shelter are monitored at the same locations in all cases, on the centroidal axis (Point Q) and near the outer edge (Point R), at a distance 1.224 m from the outside surface of the shelter wall. The wall thickness was taken as 36 min.

Figure 16A:
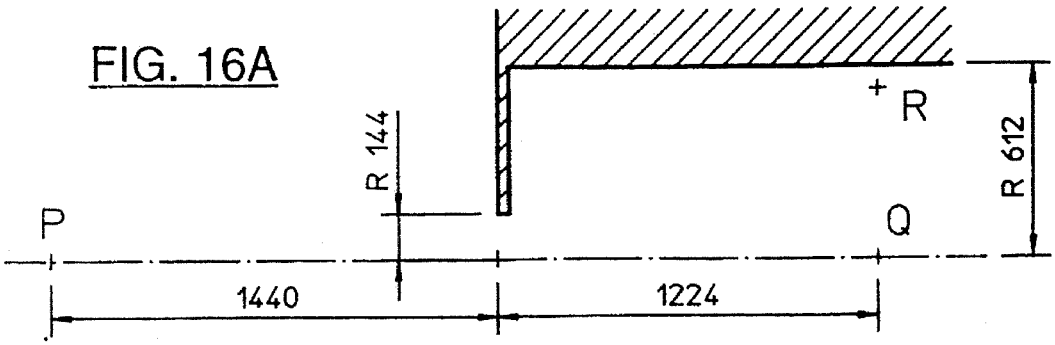
FIG. 16 shows four alternative configurations for a ventilation opening, for which, computer analysis has been carried out.
Figure 17A:
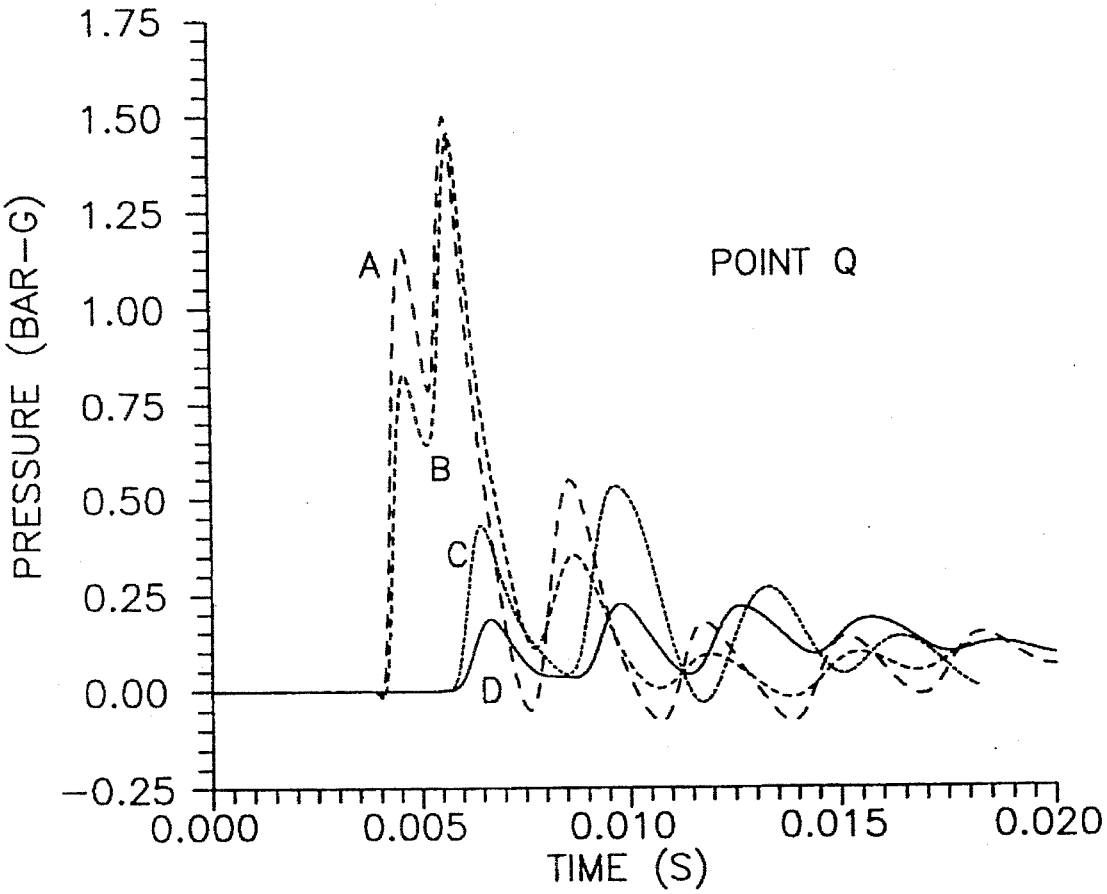
FIGS. 17A and 17B show the pressure-time graphs obtained from computer analysis of the configurations illustrated in FIG. 16.
Figure 17B:
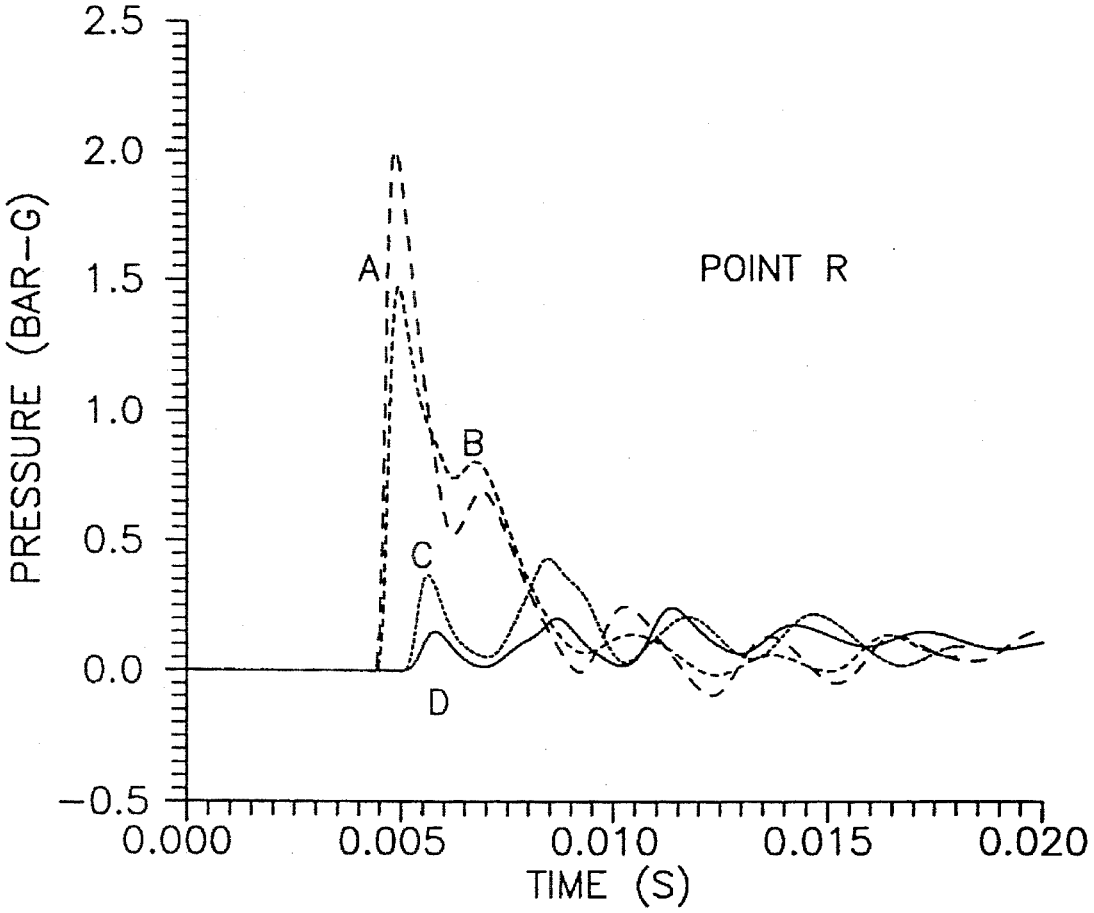

Case A: A circular hole of radius 144 mm opens into a cylindrical duct of radius 612 mm as shown in FIG. 16A. The peak pressure at Point Q is 1.53 barg and at Point R is 2.05 barg.

Figure 16B:
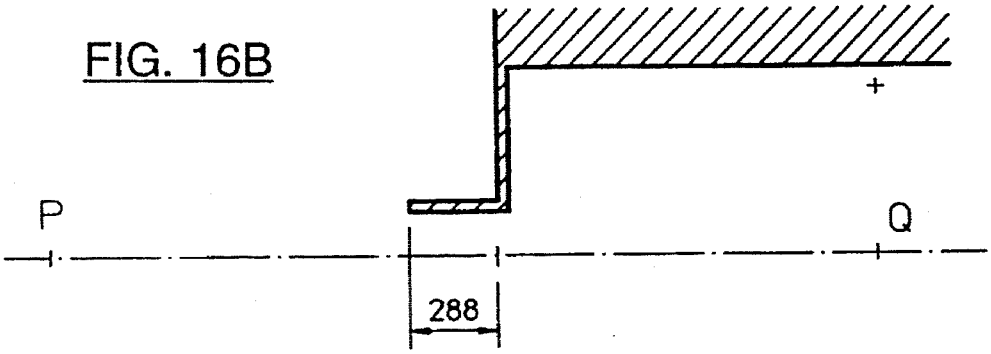

Case B: The configuration of Case A is modified by adding an entry passage as in the proposed attenuator geometry, and is illustrated in FIG. 16B. The entry is cylindrical with the same radius as the hole and is of length 288 min. The peak intensity of pressure at both monitoring points is 1.5 barg showing a more uniform pressure distribution across the duct. Note that the introduction of the protruding entry passage alone has brought down the peak pressure at Point R by 0.55 barg or 27%.

Figure 16C:
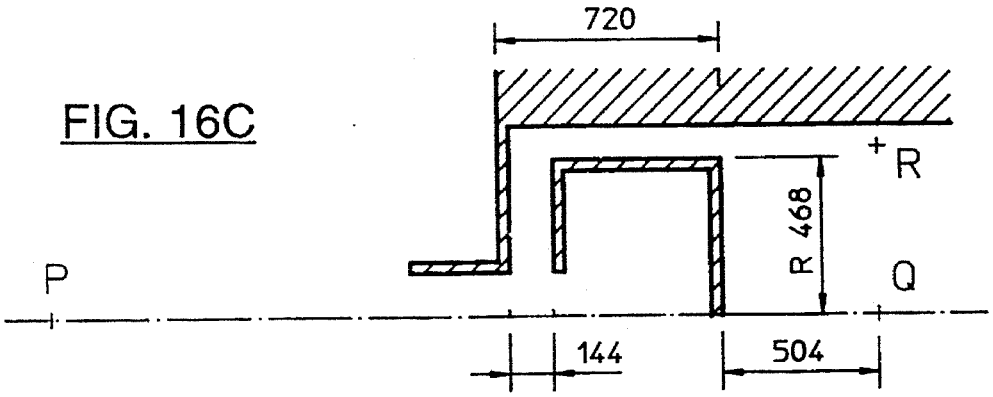
Figure 16D:
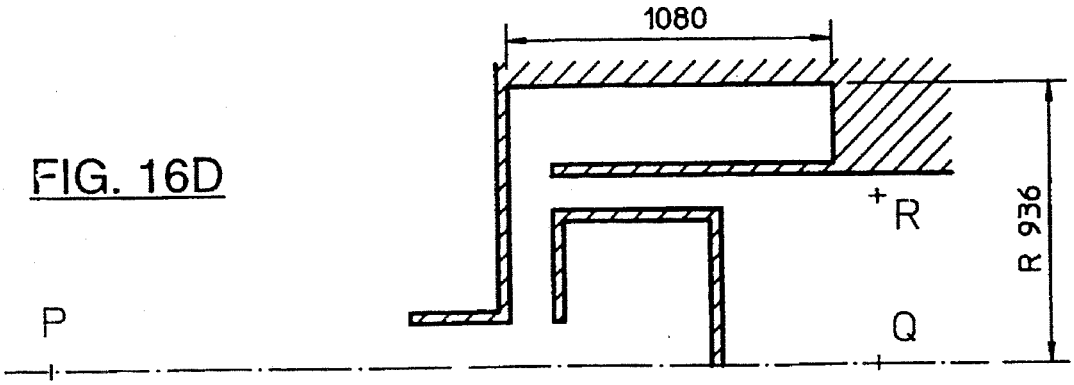

Case C: The proposed attenuator configuration illustrated in FIG. 16C is introduced at the opening. The exit passage width is 144 mm. The expansion chamber is cylindrical with internal radius 468 mm and length 468 mm. The radial gap between the outer surface of the expansion chamber and the inner surface of the duct is 108 mm. The peak pressure intensity at Point Q is 0.54 barg and at Point R is 0.44 barg. In comparison with the simple hole configuration of Case A, the maximum pressure has been brought down by 1.5 barg or 74%.

Case D: The enhanced attenuator shown in FIG. 16D with the added annular expansion chamber external to the duct boundary, is considered. The annular expansion chamber is of outer radius 936 mm, inner radius 648 mm and length 1080 mm. With this arrangement, the peak pressure drops to 0.23 barg at Point Q and 0.25 barg at Point R. In comparison with the simple hole configuration of Case A, the maximum pressure has been brought down by 1.8 barg or 88%.

Figure 18A:
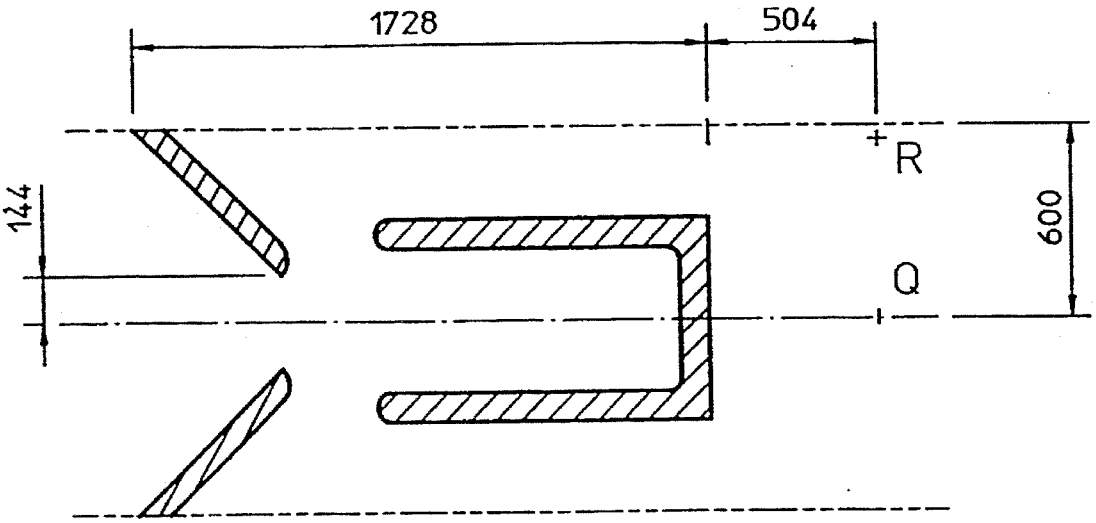
FIG. 18A (PRIOR ART)
FIGS. 18A and 18B show the sectional view of two scaled sizes of the attenuator described in U.S. Pat. No. 5,187,316.
Figure 18B:
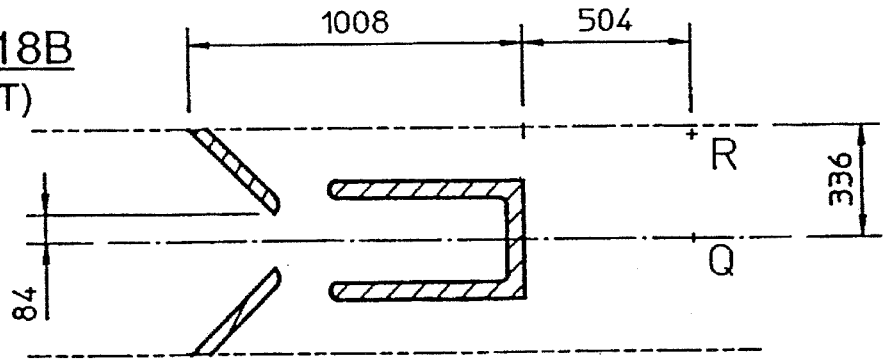
FIG. 18B (PRIOR ART)
Figure 19A:
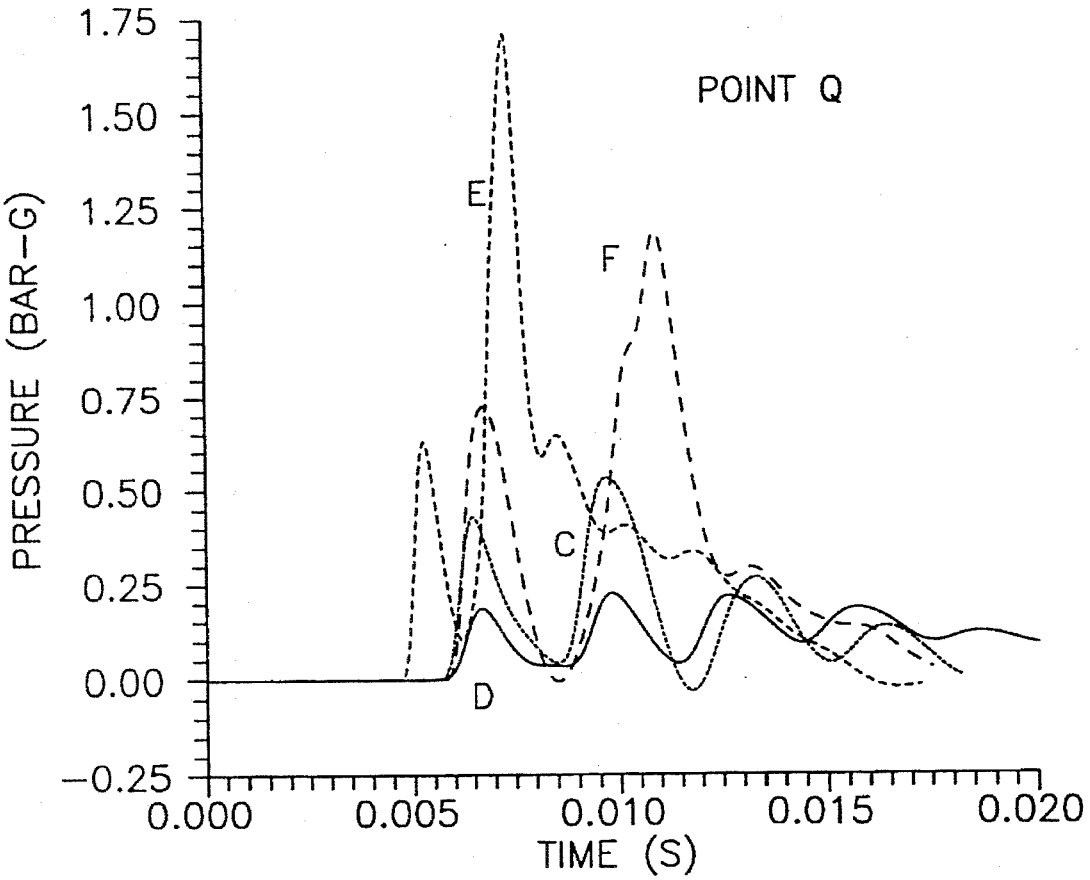
FIGS. 19A and 19B compare the pressure-time graphs obtained from computer analysis of the existing attenuator illustrated in FIG. 18 with the proposed attenuator.
Figure 19B:
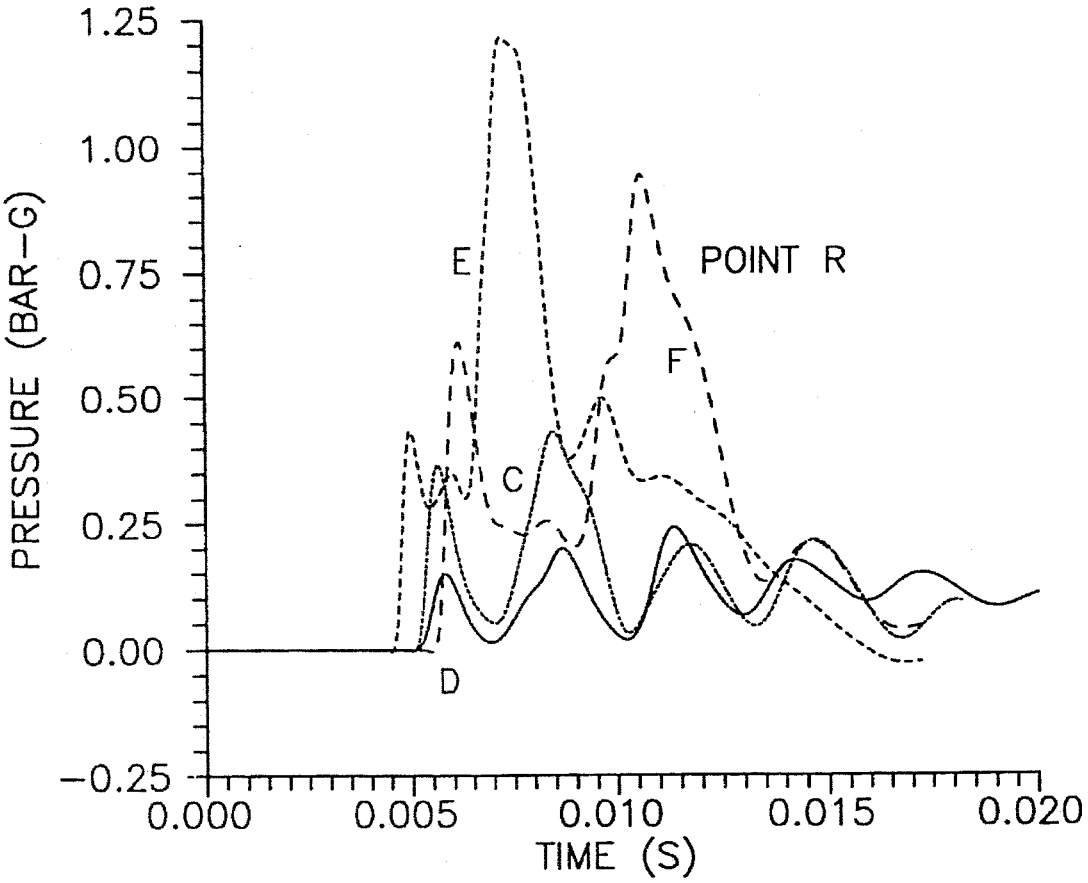

A further computer analysis to compare the proposed attenuator configuration with the attenuator described in U.S. Pat. No. 5,187,316, is presented next. Shown in FIGS. 18A and 18B are two scaled sizes of the existing attenuator, the former, Case E is of comparable length to the proposed attenuator of Case C, and the latter, Case F, of comparable entry and downstream width. In both Case E and Case F, the source pressure pulse is located 1440 mm in front of the entry opening and is of peak intensity 4 barg, decaying linearly over 5 ms.

Case E: The attenuator configuration illustrated in FIG. 18A is introduced at the opening of the ventilation duct. The length of the attenuator is 1008 mm and the entrance width is 168 mm. The peak pressure intensity at measuring is 1.7 barg at Point Q and 1.22 barg at Point R. These are considerably larger than the peak pressure intensities of Case C, 0.54 barg at Point Q and 0.44 barg at Point R. It should however be noted that the downstream cross-section of Case E is smaller than Case C, an area ratio being 0.56. If the pressure downstream of Case E is corrected for this by multiplying by the square root of the area ratio, the resulting equivalent pressure is 1.27 barg at Point Q and 0.91 barg at Point R. This is still higher than what is predicted for Case C.

Case F: The attenuator configuration illustrated in FIG. 18B is considered. The widths of the entry opening and the downstream section were of comparable size with the proposed attenuator. The peak pressure intensity at Point R is 0.94 barg and at Point Q is 1.19 barg. Note that this result is nearly equal to the corrected peak pressure intensity for Case E, and is 0.65 barg or 20% larger than the downstream pressure of Case C.

Application 4: Entrance to air blast shelter

Figure 21:
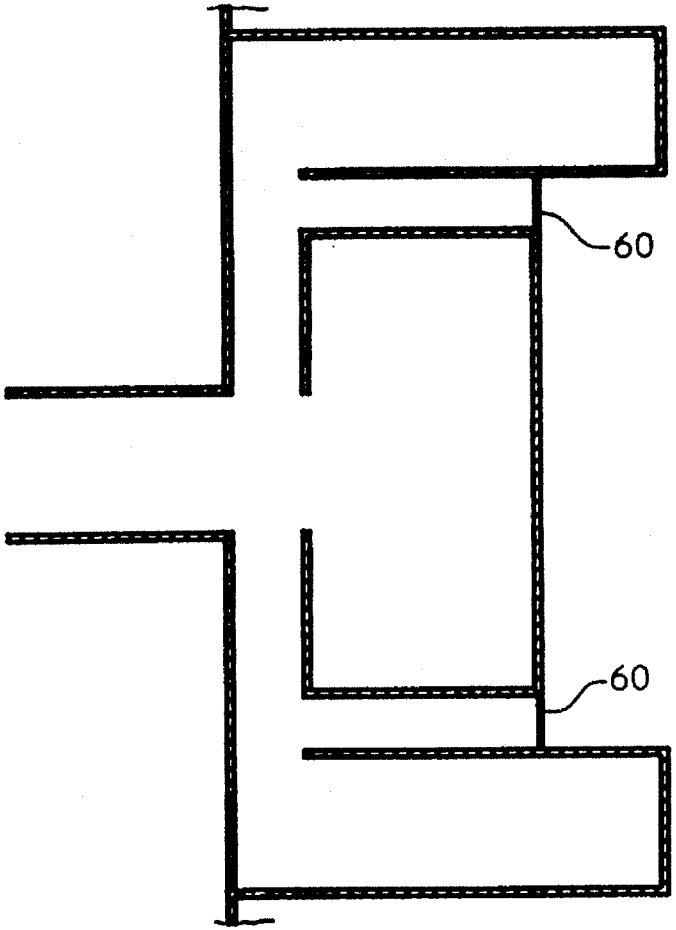
FIG. 21 shows a sectional plan view of the enhanced version of an entrance design for a blast shelter.
Figure 20:
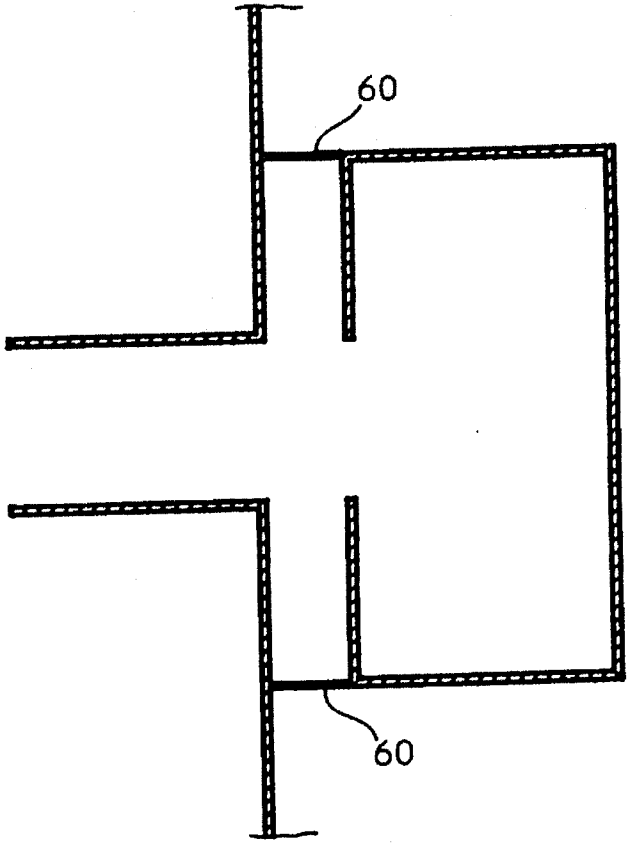
FIG.20 shows a sectional plan view of the basic version of an entrance design for a blast shelter.

Shown in FIGS. 20 and 21 are sectional plan views of the basic version and the enhanced version of an entrance design for a blast shelter. In comparison with the attenuators for ventilation openings, the difference in the shelter entrance is in the geometrical scale and the necessity to have blast doors, 60. The width of corridors that lead to the shelter have to be of sufficient width to enable movement of people, equipment and furniture. Blast doors are necessary for the protection of occupants. Due to the effective attenuation action of the configuration, the overpressure the blast doors have to withstand becomes significantly less when compared with blast doors at a conventional entrance. An added advantage is that the attenuation action of the proposed designs can increase the survival probability of the occupants if the blast doors have failed for some reason. Alternatively, this arrangement can be implemented without the blast doors (but with normal security doors) for an equipment housing where relatively higher pressure and impulse can be withstood than an enclosure for human use.

We claim:

1. A passive explosion protection device for air passing in a shelter comprising:

an inlet having an entry opening, and multiple outlet openings for connection to said shelter, said air flow being directed from said inlet to said outlet opening, said entry opening connecting with a straight entry passage, said entry passage connecting with a connection chamber; and an expansion chamber adjoining said connection chamber, said expansion chamber having a single opening directly confronting said entry opening, said expansion chamber opening aligned with and of the same cross-section as said entry opening, said connection chamber being continuously connected to multiple lateral passages perpendicular to said entry passage, each said lateral passage respectively connecting to a separate connection chamber, said separate connection chamber being continuously connected via a straight outlet passage perpendicular to said lateral passage to said outlet opening.

2. The passive explosion protection device as claimed in claim 1, further comprising additional expansion chambers each adjoining a respective said separate connection chamber, said additional expansion chambers each having a single opening directly confronting the entry opening of said lateral passage, said opening to each additional expansion chamber being aligned with and of the same cross-section as said lateral passage entry opening.

3. A passive explosion protection device for air passing in a shelter comprising:

an inlet having an entry opening, and an outlet opening for connection to said shelter, said air flow being directed from said inlet to said outlet opening, said entry opening connecting with a straight entry passage, said entry passage connecting with a connection chamber; and an expansion chamber adjoining said connection chamber, said expansion chamber having a single opening directly confronting said entry opening, said expansion chamber opening aligned with and of the same cross-section as said entry opening, said connection chamber being connected to a radial passage extending perpendicularly and radially outward from said entry passage, wherein air flow is directed radially outward and perpendicular to said air flow in said straight entry passage, said radial passage connecting to a second connection chamber, said second connection chamber connecting to an annular outlet passage leading to said outlet opening.

4. The passive explosion device as claimed in claim 3, further comprising a second expansion chamber having a single opening directly confronting the entry opening of said radial passage, said opening to said second expansion chamber being aligned with and of the same cross-section as said radial passage entry opening, said second connection chamber being continuously connected via said annular outlet passage to said outlet opening, direction of airflow in said outlet passage being perpendicular to direction of airflow in said radial passage.

5. A passive explosion protection device for shelter entrances comprising:

an inlet having an entry opening, and two outlet openings for connection to said shelter, blast doors being installed at said outlet openings, said entry opening connecting with a straight entry passage, said entry passage connecting with a connection chamber;

an expansion chamber immediately adjoining said connection chamber, said expansion chamber having only a single opening directly confronting said expansion chamber, said expansion chamber opening aligned with and of the same cross-section as said entry opening, and a diameter of said expansion chamber being greater than a diameter of said expansion chamber opening, said connection chamber being continuously connected to two lateral passages perpendicular to said entry passage, each of said lateral passages respectively connecting to an additional separate connection chamber, each said additional connection chamber being continuously connected via a straight outlet passage perpendicular to said lateral passage to said outlet opening; and two additional expansion chambers each respectively adjoining said additional connection chamber, each expansion chamber having a single opening directly confronting the entry opening of a respective one of said lateral passages, said opening to each said additional expansion chamber aligned with and of the same cross-section as each said lateral passage entry opening.

6. A passive explosion protection device for shelter entrances comprising:

an inlet having an entry opening, and two outlet openings for connection to said shelter, blast doors being installed at said outlet openings, said entry opening connecting with a straight entry passage, said entry passage connecting with a connection chamber;

a first expansion chamber adjoining said connection chamber, said first expansion chamber having a single opening directly confronting said connection chamber, said first expansion chamber opening aligned with and of the same cross-section as said entry opening, said connection chamber being continuously connected to two lateral passages perpendicular to said entry passage, each of said lateral passages respectively connecting to an additional separate connection chamber, each additional connection chamber being continuously connected via a straight outlet passage perpendicular to said lateral passage to said outlet opening; and two additional expansion chambers each respectively adjoining said additional connection chamber, each expansion chamber having a single opening directly confronting the entry opening of a respective one of said lateral passages, said opening to each said additional expansion chamber aligned with and of the same cross-section as each said lateral passage entry opening.

* * * * *

UNITED STATES PATENT AND TRADEMARK OFFICE

CERTIFICATE OF CORRECTION

PATENT NO. : 5,540,618
DATED : July 30, 1996
INVENTOR(S) : Alwis et al.

It is certified that error appears in the above-indentified patent and that said Letters Patent is hereby corrected as shown below:

Column 1:

Line 25, change "pans" to --parts--;
line 26, change "pans" to --parts--.

Column 3:

Line 14, change "decrease 5" to --decreases--.

Column 4:

Line 8, change "carded" to --carried--.

Column 5:

Line 17, change "min" to --mm--;
line 62, delete "at measuring".

Signed and Sealed this
Twenty-eighth Day of January, 1997

*Attest:*

Bruce Lehman

BRUCE LEHMAN

*Attesting Officer* *Commissioner of Patents and Trademarks*